US005858105A

United States Patent [19]

Pritchard et al.

[11] Patent Number: 5,858,105

[45] Date of Patent: Jan. 12, 1999

[54] METHOD FOR WASHING PLASTIC RETURNABLE BEVERAGE BOTTLES WITH ALKALINE SOLUTION AND ULTRASONIC ENERGY

[75] Inventors: Norman Jason Pritchard, Maarssen, Netherlands; David John Christopher, Bebington Wirral, Great Britain

[73] Assignee: Diversey Lever, Inc., Plymouth, Mich.

[21] Appl. No.: 754,952

[22] Filed: Nov. 21, 1996

[30] Foreign Application Priority Data

Dec. 1, 1995 [EP] European Pat. Off. ..... 95203319

[51] Int. Cl.[6] ..... B08B 3/12

[52] U.S. Cl. ..... 134/1; 134/22.17; 134/29

[58] Field of Search ..... 134/1, 2, 22.17, 134/22.18, 22.19, 26, 29, 184

[56] References Cited

U.S. PATENT DOCUMENTS

| | | | |
|---|---|---|---|
| 3,302,655 | 2/1967 | Sasaki et al. | 134/79 |
| 4,170,241 | 10/1979 | Clapp | 134/184 |
| 4,803,055 | 2/1989 | Ueda | 422/297 |
| 5,441,063 | 8/1995 | Fernandez et al. | 134/142 |

FOREIGN PATENT DOCUMENTS

| | | |
|---|---|---|
| 2522317 | 9/1983 | France . |
| 3440315 | 5/1986 | Germany . |
| 4225018 | 2/1994 | Germany . |
| 4322328 | 1/1995 | Germany . |
| 292878 | 7/1965 | Netherlands . |
| 7208697 | 12/1973 | Netherlands . |

*Primary Examiner*—Jill Warden
*Assistant Examiner*—Saeed Chaudhry
*Attorney, Agent, or Firm*—A. Kate Huffman

[57] ABSTRACT

The invention relates to a method for cleaning returnable beverage bottles, particularly plastic bottles comprising the following steps: pre-treating the bottles with a concentrated cleaning formulation comprising more than about 0.5% by weight of an alkaline agent, followed by removing the cleaning formulation and soil in one or more subsequent stages.

15 Claims, 2 Drawing Sheets

FIG.I

METHOD FOR WASHING PLASTIC RETURNABLE BEVERAGE BOTTLES WITH ALKALINE SOLUTION AND ULTRASONIC ENERGY

FIELD OF THE INVENTION

The present invention relates to a method of cleaning bottles, in particular returnable polyethylene terephthalate (PET) bottles.

BACKGROUND OF THE INVENTION

Recently, glass bottles have been gradually replaced by PET bottles, particularly for the sale of soft drinks, for the following reasons. The sale of soft drinks offers the manufacturer the advantage of higher volumes per unit sold. Furthermore, the consumer is offered the convenience of higher volumes of product per unit weight.

Where the infrastructure exists to apply the process of returning, cleaning and reusing PET-bottles, there is the additional possibility of cost saving.

Systems for glass bottle washing are mature and with the gradual replacement of glass by PET, the tendency has been to clean PET bottles by the same process. Although current systems achieve effective results, the process is far from optimal.

Generally, the cleaning of the bottles occurs immediately before refilling, thus minimizing the risk of resoiling and infection. Cleaning is effectively carried out in an industrial bottle washer which typically can handle from 5000 to 100,000 bottles per hour, depending on the machine capacity.

The conventional cleaning solution usually contains about 1% by weight of sodium hydroxide and an antifoam agent and is applied at a temperature of about 60° C. It is often applied by way of a soaking stage followed by a spray stage, prior to rinsing, or else by just spraying before rinsing.

Since the bottle cleaning process occurs immediately before filling of the bottles in a continuous feed process, this cleaning process could be considered to constitute an intrinsic part of the bottling process.

The conventional bottle cleaning process usually takes about 25 minutes per bottle. It would be commercially highly attractive if this cleaning time could be reduced while retaining good cleaning performance.

It is therefore an object of the present invention to provide a method of cleaning returnable bottles, particularly PET bottles, which takes less time than the known methods of the prior art but gives substantially equal cleaning performance.

DEFINITION OF THE INVENTION

According to a first aspect, the present invention provides a first method for cleaning returnable beverage bottles, particularly plastic bottles comprising the following steps:

pre-treating the bottles with a concentrated cleaning formulation comprising at least roughly 5 by weight of an alkaline agent, followed by removal of the cleaning formulation and soil in one or more subsequent stages.

According to a second aspect of the present invention, there is provided a second method for cleaning returnable beverage bottles, particularly plastic bottles, with a cleaning formulation, comprising:

washing the bottles whilst subjecting these to ultrasonic energy, the bottles being shaken at substantially the same frequency as the frequency of the ultrasonic energy, characterized in that the cleaning formulation is sprayed into the bottles which are secured substantially upside down.

According to a third aspect of the present invention, there is provided a third method for cleaning bottles.

DETAILED DESCRIPTION OF THE INVENTION

Figure 1:
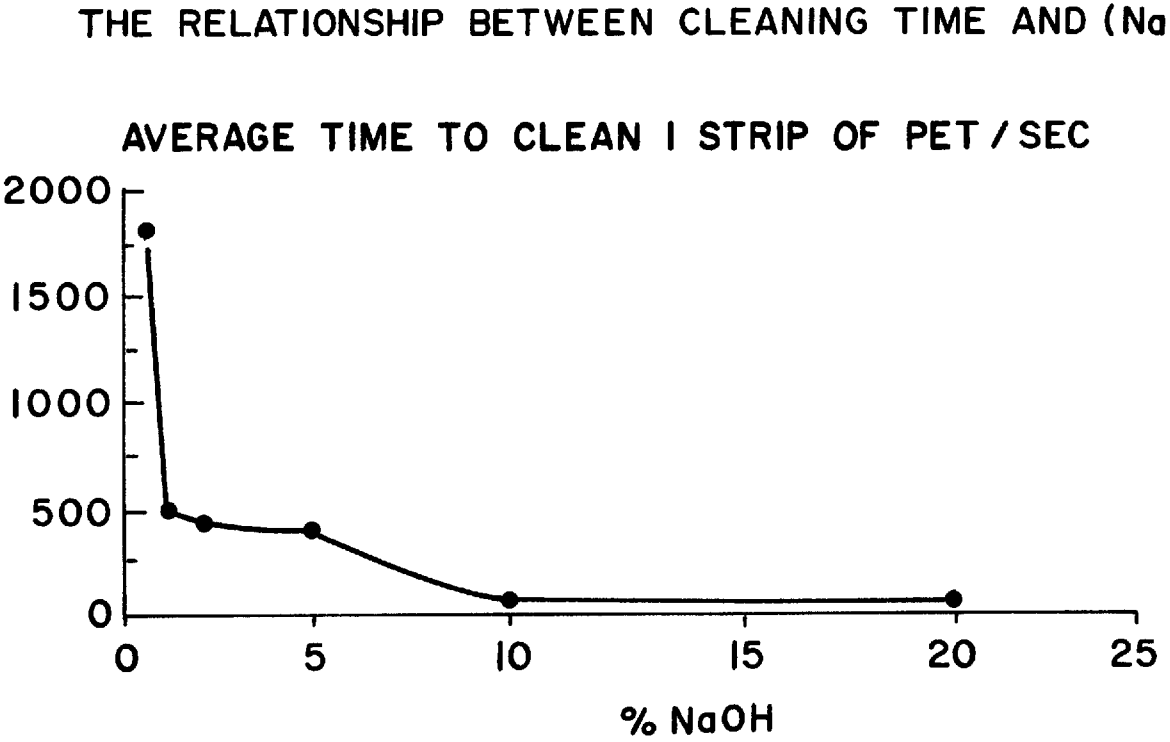
FIG. 1 is a graph depicting the relationship between cleaning time and NaOH.

It was surprisingly found by the inventors that exposure of the bottles to a concentrated cleaning formulation for a determined period of time enhanced cleaning without substantially damaging the bottles.

The concentrated cleaning formulation comprises at least 5% by weight of an alkaline agent wherein the upper limit by percentage weight of the concentrated alkaline agent is dependent on the exposure time of the bottles thereto. Obviously a critical factor is that in the case of PET bottles, these do not suffer any adverse effects, such as bottle shrinkage and damage to the plastic.

It is well-known that the risk of such adverse effects increases with increasing concentration of alkaline agent, increasing length of contact time between PET bottles, for instance, and alkaline agent, and increasing temperature of the alkaline agent solution. For instance, it was found in this respect that at a concentration of 10% by weight of sodium hydroxide, as an alkaline agent, the maximum aggregate exposure time, at which damage to the bottles was not detected, was two hours.

A contact time, for the concentrated cleaning formulation, of at least about 1 second will be sufficient for a desired chemical, as opposed to mechanical, cleaning action, accordingly the bottles can be exposed to the alkaline agent for about 1–300 seconds and preferably 1–60 seconds per individual wash, dependent on the concentration of the alkaline agent.

In order to provide the desired prolonged intimate contact, the mechanical effect of spraying, washing or rinsing is preferably minimized, if not avoided.

Following pre-treatment exposure to the concentrated cleaning formulation the bottles are preferably soaked in a dilute cleaning formulation comprising less than about 3% by weight of an alkaline agent in order to minimise adverse effects.

The alkaline agent may be selected from the group consisting of alkali metal hydroxides, silicates and carbonates. The preferred type of alkaline agent is sodium hydroxide.

Since it is postulated that the application of concentrated sodium hydroxide cleans by a chemical effect, rather than the physical effect of spraying a hot liquid onto the bottle surface the application method of the sodium hydroxide is not too important, providing sufficient coverage is achieved. Accordingly the cleaning formulation does not need to be pumped through the bottle washing machine, but can be applied as a spray, thus yielding a saving in time in the bottle washing process which accordingly is cost attractive.

In order to optimize results, it is important that substantially the whole (internal and external) surface of the soiled bottles should be contacted by the sprayed concentrated cleaning formulation. A fine mist-like spray is particularly desirable. More particularly, the volume sprayed and/or the number and/or arrangement of spray nozzles is/are preferably selected so that low volume and low intensity spraying will ensure the desired type of complete coverage and even distribution.

Generally, a bottle washing machine may comprise one or more prewash cycles or zones, which may be optional, for example to remove heavy soil, and one or more wash zones and one or more rinse zones. According to the present invention, the cleaning formulation of unusually high concentration is sprayed somewhere prior to the final rinse.

A conventional bottle washing machine may be adapted in order to be suitable for carrying out the method of the invention, for example by addition of extra spray nozzles and associated systems and/or by modification to the control systems of the machine.

Preferred method conditions are lain out in the claims.

Ultra-Sonic Energy

A method for cleaning bottles with the aid of ultra-sonic energy is known from DE 1088835. A problem with this method is that it is relatively slow.

Since according to the second aspect of the present invention, the bottles are secured upside down and cleaning formulation is sprayed into the bottles whilst these are shaken, used cleaning formulation can readily escape and a quick cleaning process is provided.

The present invention will now be further clarified with respect to the following description and experimental results.

To test the effectiveness of the cleaning solutions used on PET, a fast screening method was used, which kept bottle use to a minimum thus allowing more formulations to be screened.

The methodology was as follows. A soiled bottle was cut into strips (replicates) approximately 5×3 cm, with the soiling on the internally curved surface. The soiled plastic was suspended by a plastic cable tie in a beaker of detergent solution and the free end clipped to the edge of the beaker and arranged such that maximum flow occurs over the surface of the plastic. The detergent solution was stirred and the temperature thermostatically controlled. Assessment of cleaning was done visually. The sample was briefly removed from the detergent solution and checked to see how much soil film remained.

The bottles were soiled by treatment with a solution of tomato juice and the micro-organism aspergillis niger grown thereon during an incubation period. This produced soiling in the form of patches of black mould (termed pads) at the surfaces of the bottles.

Comparisons were made between cleaning PET strips with a 0.3% commercially available detergent formulation, SU860, at 60° C. and those that had been pre-treated with a concentrated solution of sodium hydroxide.

A 10% (2.7 mol/l) solution of sodium hydroxide containing 240 ppm of standard nonionic surfactant solution, a plurafac LF mix, ex BASF, at 60° C. was used to clean the soiled PET strips.

The results, in table 1, show that there is a significant time saving to be gained by pre-treating the PET strips with concentrated sodium hydroxide solution before cleaning with detergent.

TABLE 1

| Experiment No. | Replicates | Experimental Conditions | Results |
|---|---|---|---|
| 1 | 4 | SU860 0.3% + 1% NaOH 600 s | few small patches of soil |
| 2 | 2 | Pre soak 10% NaOH 120 s<br>SU860 0.3% + 1% NaOH, 240 ppm surfactant mix | very few patches of soil remaining, mostly clean 99% clean, in 250 s |

TABLE 1-continued

| Experiment No. | Replicates | Experimental Conditions | Results |
|---|---|---|---|
| 3 | 3 | Pre soak 10% NaOH 60 s<br>SU860 0.3% × 1% NaOH, 240 ppm surfactant mix | a few patches of soil seen under microscope 95% clean, in 192 s |
| 4 | 2 | Pre soak 10% NaOH 30 s<br>SU860 0.3% + 1% NaOH, 240 ppm surfactant mix | some patches of soil seen under microscope 90% clean, in 170 s |
| 5 | 3 | Pre soak 10% NaOH 120 s<br>SU860 0.3% + 1% NaOH | cleaned in 190 s |
| 6 | 3 | Pre soak 10% NaOH 60 s<br>SU860 0.3% + 1% NaOH | cleaned in 110 s |
| 7 | 3 | Pre soak 10% NaOH 30 s<br>SU860 0.3% + 1% NaOH | cleaned in 135 s |

The pre-treatment with 10% NaOH solution cleaned the PET strips very effectively, and little distinction could be drawn between the different exposure times. Further investigation with the aid of a microscope (magnification ×40) showed that there were a few patches of soil still left on the surface of the PET. The extent of the remaining soil decreased with increasing exposure time of the PET to the concentrated sodium hydroxide. In order to test whether the surfactant has an effect on the cleaning, the experiments 2, 3 and 4 were repeated with experiments 5, 6 and 7 without the surfactant. The results are similar, in that the strips are clean in 2–3 minutes. This showed that the cleaning is primarily due to the effect of the concentrated sodium hydroxide solution, and that in this instance the surfactant was not aiding the cleaning.

The pre-soak with sodium hydroxide accelerates the cleaning process from an average total time of 600 s down to an average of 250 s.

Concentrated solutions of sodium hydroxide are known to damage PET when exposure times are long. If however the time is kept short enough just to penetrate the soil on the bottle then damage to the substrate is minimal.

Experiments were subsequently carried out on whole bottles in a conventional spray bottle washing machine.

The soiled bottles used in these tests were dried and matured for over 3 weeks. The soiling is well developed and appeared to be dried on to the inside of the bottles. These bottles were soiled in the same manner as the PET strips above.

The time taken for bottles to be cleaned was, according to the present invention, reduced by using a hot pre-soak of concentrated NaOH.

Following a cold rinse of the bottles to remove loose particulates and to keep the detergent liquor from becoming too soiled, a fine spray of concentrated NaOH lasting about 10 seconds at 60° C. was applied by handspray to the inside of the soiled bottles. This procedure delivered approximately 8–10 ml of solution. The NaOH was allowed to soak on the surface of the bottle for up to 2 minutes. The bottle was then spray rinsed with a 0.3% of the detergent SU860 in 1% NaOH, at 60° C. in a spray bottle washing machine. The experimental results shown in table 2 cover two levels of NaOH concentration, two exposure times and subsequent wash with detergent solution.

TABLE 2

Effect of NaOH concentration and time on pretreating PET bottles

| Experiment No. | Replicates | Experimental details | % clean |
|---|---|---|---|
| 1 | 4 | 30% NaOH spray 30 s | 95 |
| 2 | 2 | 30% NaOH spray 120 s | 99 |
| 3 | 2 | 30% NaOH spray 30 s, SU860 60° C. 120 s | 99 |
| 4 | 2 | 30% NaOH spray 30 s, SU860 60° C. 60 s | 95 |
| 5 | 2 | 10% NaOH spray 30 s, SU860 60° C. | 95 |
| 6 | 2 | 10% NaOH spray 120 s, SU860 60° C. | 99 |

On most of the bottles there were a very few small patches of soil remaining after cleaning. These become visible when the bottles are dried and tend to be near the neck of the bottle. The results show that good cleaning may be achieved by using a 10% NaOH spray at 60° C. followed by a detergent soak of 2 minutes.

Further research was carried out to find out whether increasing the sodium hydroxide concentration decreased the total time required to clean the bottles. In order to find this out, the concentration of sodium hydroxide with an adjunct of 0.1% SU860 was used to clean strips of PET at 60° C. The results are shown in the table 3 and the graph in FIG. 1.

TABLE 3

Data for concentration versus time for pretreatment on whole PET bottles

| Experiment No. | % NaOH | Molar concentration/ mol/l | Time to clean/s |
|---|---|---|---|
| 1 | 0.5 | 0.125 | 1800 |
| 2 | 1 | 0.252 | 480 |
| 3 | 2 | 0.510 | 420 |
| 4 | 5 | 1.317 | 390 |
| 5 | 10 | 2.772 | 60 |
| 6 | 20 | 6.094 | 50 |

The relationship between sodium hydroxide concentration and cleaning time is clearly not linear and actually contained two steps. The greatest advantage to be gained is when the sodium hydroxide concentration was above 5%. The form of the graph suggested that there could be a stoichiometric relationship between the hydroxide and the soil, and that some form of hydrolysis is taking place.

Too long a contact time between PET and sodium hydroxide solutions is well known to lead to problems such as bottle shrinkage and damage to the plastic.

Research was carried out to investigate the effect of short contact times at higher concentrations on PET.

Sections of PET bottles were subjected to stress by bending to a defined curvature and then exposed to the detergent solutions under the required conditions. All of the strips of PET used in each experiment were cut from the same new bottle. This was done to reduce the possibility of variation in PET composition or bottle history altering the result. The compositions of the solutions to which each strip was exposed is shown in the table 4 below. The temperature of all the solutions was 60° C.

TABLE 4

Chemical damage to PET strips. Solution conditions and results.

| Experiment No. | Damage assessment Formulation | Exposure time/hours 2 | 6 | 21 |
|---|---|---|---|---|
| 1 | 1% NaOH | None | None | None |
| 2 | 10% NaOH | Some surface marks | Some whitening | Severe whitening |
| 3 | 30% NaOH | Severe whitening and some cracking | Severe whitening, some cracking | weakened, several areas of stress cracking |
| 4 | 1% NaOH + 0.3% SU860 | None | None | None |
| 5 | 1% NaOH + $H_2O_2$ | None | None | None |
| | Water (Reference) | None | None | None |

As a control, one strip of PET was kept under tension for 21 hours at room temperature and not immersed in any solution. This control showed no damage which indicates that any damage that does occur is not due solely to the physical stresses imposed on the plastic, but to the combination of physical and chemical effects.

A solution of 10% NaOH began to cause some surface marks to appear on the PET after 2 hours and whitening of the surface appeared after 6 hours. No stress cracking was visible.

However, 30% NaOH severely damaged the PET.

At the shortest 2 hours exposure, there was extensive whitening.

With an exposure time of 2 minutes, the 10% NaOH was sufficient to act as an efficient pretreatment for the PET. Neither the hydrogen peroxide nor the commercially available SU860 detergent adjunct with 1% sodium hydroxide appeared to damage the plastic at all.

Hydrogen peroxide decomposes in alkaline media to give oxygen. As well as the well known bleaching effect of this redox reaction, there is exhibited the physical effect of gas generation at a surface. The inventors have applied this phenomenon, in penetrating a soil hydration layer residing on PET bottles.

The rate of hydrogen peroxide decomposition depends on the hydroxide concentration.

Experiments were carried out, wherein strips of PET, soiled as above, were exposed to $H_2O_2$ in the presence of NaOH. On addition of the soiled strip to the peroxide solution, effervescence commenced after a few seconds and the formation of oxygen bubbles appeared to be centered on the particles of soil adhered to the surface. The mould particles were soon removed, and large oxygen bubbles grew on the surface of the PET.

As this method relied on the generation of a gas, the formulation has a finite lifetime and this was investigated. For experiment 1 the lifetime of the alkali/peroxide solution was tested, and there appeared to be no loss in performance after one hours use. The results of the experiments are tabulated below in table 5.

TABLE 5

| Experiment No. | replicates | Formulations and results from cleaning with hydrogen peroxide based solutions. Formulation | Results |
|---|---|---|---|
| 1 | 4 | 0.12% NaOH 1% $H_2O_2$, 40 ppm surfactant, 1% NaOH | 345 s 100% clean |
| 2 | 5 | 1% $H_2O_2$ + 1% NaOH | 260 s, 100% clean |
| 3 | 2 | 0.01% $H_2O_2$ + 0.1% NaOH | 1360 s, few bubbles evolved |
| 4 | 2 | 0.1% $H_2O_2$ + 0.1% NaOH | 830 s |
| 5 | 1 | 1.0% $H_2O_2$ + 0.1% NaOH | 390 s |
| 6 | 4 | high nonionic/gluconate $H_2O_2$ | 270 s |

Figure 2:
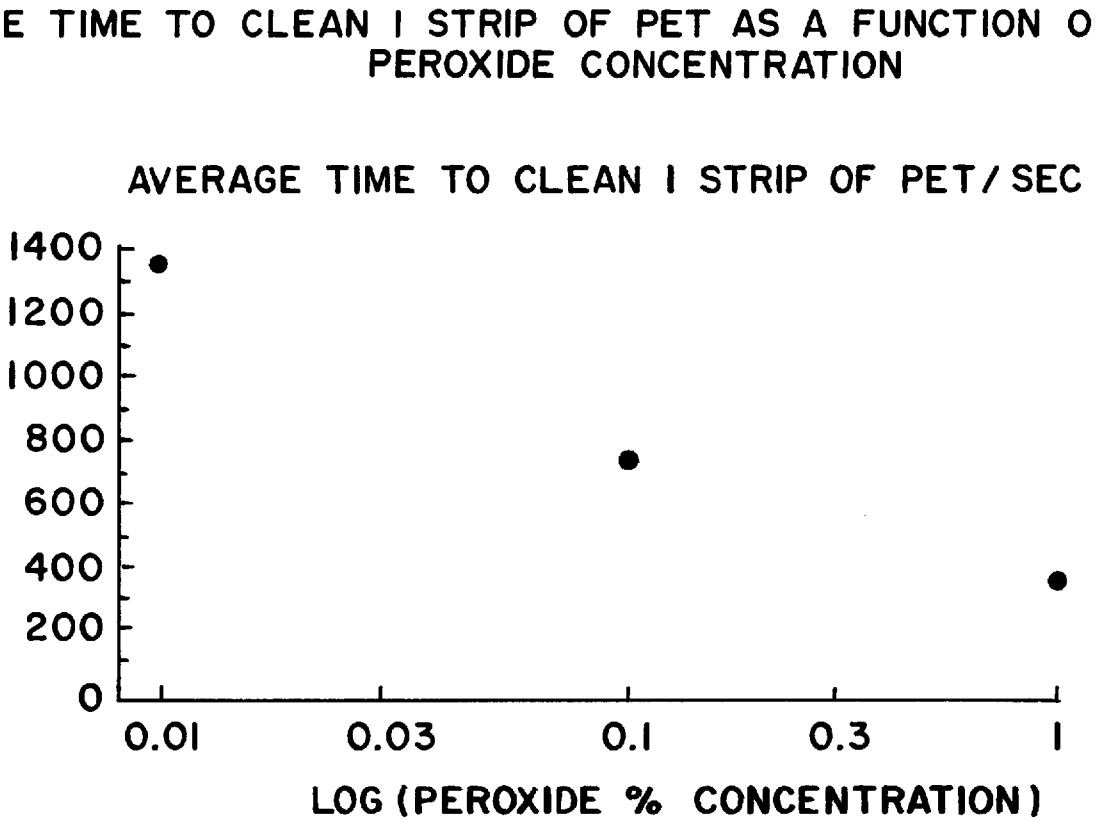
FIG. 2 is a graph showing the average time to clean a pet strip as a function of hydrogen peroxide concentration.

Experiments 3, 4 and 5 compare the hydrogen peroxide concentration with the time taken to clean the PET strips. The graph in FIG. 2 showed that the time taken to clean the strips depends on the concentration of hydrogen peroxide.

Comparing experiments 1 and 6, there is no additional benefit to the cleaning time to be gained by including the full formulation, which implies that most of the benefit derives from the use of hydrogen peroxide and alkali.

The cleaning of the formulation is separate from the lifetime of the cleaning solution. In these experiments, only the cleaning was examined, save for experiment 1 where the cleaning was done over the period of about an hour. The hydrogen peroxide had not decomposed sufficiently to affect the cleaning time of the solution.

The formulation which can contain sequestering agents, may also have a longer lifetime as the sequestering agents will reduce the free concentration of heavy metals that would otherwise catalyze the decomposition of hydrogen peroxide.

To test whether the performance of the peroxide formulation is due to the physical generation of gas, in this case oxygen, or whether the redox chemistry is important, comparative tests using sodium bicarbonate and dilute acid to generate carbon dioxide were carried out. A 1.25% (0.150 mol/l) solution of sodium bicarbonate had a pH value of approximately 9, and this solution did not clean soiled PET strips at 60° C. Addition of 1% (0.159 mol/l) of nitric acid solution caused effervescence and generation of carbon dioxide. Some cleaning of the soil occurred, but only a small amount, whereas alkaline hydrogen peroxide provided a fast route to cleaning.

From the results the most likely mechanism is thought to be physico-chemical whereby penetration of the hydrogen peroxide into the soil layer and subsequent decomposition to generate oxygen bubbles causes the soil film to be dislodged.

Research was further carried out to investigate the effects of subjecting soiled PET bottles to ultra-sonic energy.

Two types of laboratory ultrasonic baths were used for the following experiments:

amplitude modification that operates at a single frequency (20 kHz) and, frequency modulation.

Table 6 shows the results for cleaning two strips of PET, soiled as previously, to the conditions shown.

TABLE 6

| Experiment No. | Replicates | Ultrasonic cleaning at 20° C. Experimental Conditions | Results |
|---|---|---|---|
| Q1 | 1 | 300 s in water at 20° C. with ultrasonic activation | Some mould particulates removed. Some breakdown of polysaccharide film |
| Q2 | 1 | 300 s in water at 20° C. | No change |

Cold water and ultrasonic energy removed (ref. Q1) all of the surface mould and began to break down the surface soil film.

The control experiment Q2, without ultrasonic activation loosened only a small amount of the surface mould.

For comparison, it was tested whether ultrasonic activation aided the cleaning by a fully formulated detergent solution. To this end, strips of PET, soiled as previously, were exposed to a solution of 1% NaOH with 0.5% SU860 adjunct. (See table 7 for results)

TABLE 7

| Experiment No. | Replicates | Ultrasonic cleaning of PET strips with detergent at 60° C. Time (s) of exposure to experimental conditions (0.5% Su860 + 1% NaOH) | Exposure to ultrasonics | Results |
|---|---|---|---|---|
| R0 | 1 | 300 | No | Some soil remaining |
| R1 | 1 | 300 | Yes | Clean |
| R2 | 1 | 120 | Yes | Clean |
| R3 | 1 | 180 | Yes | Clean |
| R4 | 1 | 240 | Yes | Clean |
| R5 | 1 | 60 | Yes | Some soil remaining |
| R6 | 1 | 30 | Yes | Soil remaining |

From table 7 it is concluded that the ultrasonic activation accelerates the cleaning process.

To determine how much time is required to clean a PET strip with ultrasonic energy and detergent formulation, the PET strips were subjected to cleaning for different times. The results were best seen after drying in air on which the dehydrated and became visible. This was most easily examined under the optical microscope. The results suggested that the period of ultrasonic energy is preferably in excess of 60 seconds as soil was left on the PET strips for times less than this.

A period of ultrasonic activation of 1 to 2 minutes allowed thorough cleaning of the PET.

To further improve the cleaning process, the bottles may be shaken at substantially the same frequency as the ultrasonic energy in order to minimize shadow effects, caused by the bottle, which impede the ultrasonic waves. Cleaning of whole bottles was then carried out with the application of ultrasonics.

Bottles were filled with the solutions shown in the following table 8 and subjected to the conditions therein. Since use of a single frequency ultrasonic energy in conjunction with a number objects of fixed dimensions may lead to vibration patterns which leave nodes, frequency sweeping is preferably used.

TABLE 8

| Cleaning of PET bottles using ultrasonic activation | | | |
|---|---|---|---|
| Experiment | Replicates | Experimental details | % clean |
| a | 1 | Water only 45° C. 60 s soak | 50 |
| b | 1 | SU860 45° C. 180 soak | 50 |
| c | 1 | Water 45° C. US 60 s | 95 |
| d | 1 | Water 45° C. US 120 s | 95 |
| e | 1 | SU860 45° C. US 120 s | 100 |
| f | 1 | Water 45° C. 60 s US, SU860 US 60 s | 100 |

SU860 is an alkaline sequestrant containing bottle washing agent.

TABLE 9

| Summary of results of cleaning of PET bottles with ultrasonic energy | | |
|---|---|---|
| Extent of cleaning % | Water only 45° C. | SU860 0.5%, 1% NaOH 45° C. |
| with ultrasonic energy | 95 | 100 |
| no ultrasonic energy | 50 | 50 |

Table 9 above summarizes the results from table 8. The results indicate that complete cleaning of the bottles as measured visually is achieved when the PET is exposed to detergent solution at elevated temperature and ultrasonic energy. Also that the ultrasonic energy has greater effect on shortening the cleaning times than changing from water to detergent solution.

Further to this, the application route for the ultrasonic energy was explored. The use of an ultrasonic welding gun to apply energy directly to the bottle was investigated. Using a bottle held in the bottle washer machine and spraying 0.5% SU860 with 1% NaOH at 60° C. and applying ultrasonic energy directly to the bottle holder for 60s to the bottle, the bottle was found to be >95% clean. This suggested that the cleaning is independent of route of application of ultrasonic energy.

We claim:

1. A method of cleaning plastic returnable beverage bottles comprising the steps of:

(i) selecting a concentrated cleaning formulation comprising from 5 to 50% by weight of an alkaline agent;

(ii) pretreating the bottles with the cleaning formulation while applying ultrasonic energy to the bottles;

(iii) soaking the bottles in a dilute cleaning formulation comprising less than about 3% by weight of the alkaline agent; and (iv) removing the dilute cleaning formulation and soil in one or more subsequent steps.

2. Method according to claim 1, wherein the alkaline agent comprises sodium hydroxide.

3. Method according to claim 1, wherein contact of the concentrated cleaning formulation is from about 1–300 seconds.

4. Method according to claim 3, wherein the pretreatment step is carried out at a temperature of between 40° C. to 80° C.

5. Method according to claim 1, wherein the dilute cleaning formulation comprises sodium hydroxide at a concentration of between 0.5 to 1.5% by weight.

6. Method according to claim 5, wherein the soaking step is carried out for between 30 seconds to 5 minutes.

7. Method according to claim 6, wherein the soaking step is carried out at a temperature of between 10° C. to 80° C.

8. Method according to claim 1, wherein the concentrated cleaning formulation further comprises a detergent.

9. A method according to claim 8 wherein the detergent is an alkaline sequestrant containing bottle washing agent.

10. Method according to claim 1, wherein the concentrated cleaning solution is sprayed into and or onto the bottles.

11. Method according to claim 1, wherein the pretreating step (ii) further comprises an oxidizing agent.

12. Method according to claim 11, wherein the oxidizing agent is hydrogen peroxide.

13. Method according to claim 1, wherein the bottles are shaken at a frequency substantially corresponding to the frequency of the ultrasonic energy.

14. A method according to claim 1, further comprising a reconcentration step wherein a sodium hydroxide solution is introduced in the pretreating step (ii) and the sodium hydroxide solution is carried over from the pretreating step to the soaking step (iii).

15. A method according to claim 14, wherein the reconcentration step further comprises reintroducing sodium hydroxide solution from the soaking step to the pretreating step.

* * * * *